United States Patent [19]

Mendenhall

[11] 4,066,247

[45] Jan. 3, 1978

[54] MIXING APPARATUS

[76] Inventor: Robert L. Mendenhall, 1770 Industrial Road, Las Vegas, Nev. 89102

[21] Appl. No.: 601,176

[22] Filed: Aug. 1, 1975

Related U.S. Application Data

[63] Continuation-in-part of Ser. No. 487,927, July 12, 1974, abandoned, and Ser. No. 487,928, July 12, 1974, abandoned, and Ser. No. 488,518, July 15, 1974, Pat. No. 4,000,000.

[51] Int. Cl.[2] ..... B28C 1/22; F28F 7/00; F28D 11/06; F28D 7/00

[52] U.S. Cl. ..... 366/24; 165/82; 165/84; 165/159

[58] Field of Search ..... 259/155–159 R, 259/150, 147, 3, 14, 30, 81 R; 34/108, 138; 165/84, 95, 159, 81–83, 91–93, 161, 178

[56] References Cited

U.S. PATENT DOCUMENTS

| | | | |
|---|---|---|---|
| 1,904,875 | 4/1933 | Metzgar | 165/159 |
| 2,664,274 | 12/1953 | Worn | 165/84 |
| 2,859,948 | 11/1958 | Callard | 165/82 |
| 2,969,956 | 1/1961 | Forgo | 165/82 |
| 3,578,072 | 5/1971 | Kolm | 165/84 |
| 3,588,052 | 6/1971 | Scholtz | 259/3 |
| 3,845,941 | 11/1974 | Mendenhall | 259/157 |

*Primary Examiner*—Leonard D. Christian
*Assistant Examiner*—Robert Pous
*Attorney, Agent, or Firm*—Seiler & Quirk

[57] ABSTRACT

In a heating and mixing apparatus having an elongated cavity and a plurality of heating tubes extending along the length of the cavity, the improvement comprises at least one supporting member for the tubes and lying across the cavity along a plane approximately normal to the axis of the tubes and having a plurality of orifices through which the tubes extend. The support member has at least one opening therein to allow composition to pass therethrough, and preferably a plurality of the supports are spaced along the drum and disposed so that the openings of adjacent supports are not aligned with one another, thereby acting as temporary barriers for the composition as it is drawn gravitationally from one end of the apparatus to the other during heating and mixing process. In another embodiment, a portion of the support extends exteriorly of the drum and is exposed whereby the exposed portion may be agitated and which agitation is translated through the support to the tubes which causes vibration for assist in removing composition coated on the tubes.

5 Claims, 3 Drawing Figures

MIXING APPARATUS

BACKGROUND OF THE INVENTION

This application is a continuation-in-part of my co-pending applications Ser Nos. 487,927, filed July 12, 1974 and now abandoned, Ser. No. 487,928 filed July 12, 1974 and now abandoned and 488,518, filed July 15, 1974 and now U.S. Pat. No. 4,000,000.

In my aforesaid co-pending applications as well as my U.S. Pat. No. 3,845,941 there are described processes and apparatus for recycling used asphalt-aggregate compositions. That apparatus, of which the present invention constitutes an improvement, includes an elongated cylindrical drum having a plurality of heating tubes extending substantially along the length of the drum interior. Used asphalt-aggregate compositions are recycled by introducing them into an input end of the drum and rotating the drum while heating the tubes so that the composition becomes heated gradually by contact with the heated tube surfaces. The heated and mixed composition is then recovered at the output drum end. The description in my aforesaid applications and patent of the apparatus and method of its use in producing recycled asphalt-aggregate compositions are incorporated herein by reference.

Previous methods of heating asphalt compositions utilizing tumbling action within a cylinder such as described in U.S. Pat. No. 3,423,222 are inefficient since the materials are directly exposed to flame emitted from a burner. Not only does such exposure to direct flame or hot gases cause burning and deterioration of asphalt but since the only portion of the material being heated is that exposed on the surface of the mass the process is relatively inefficient. Moreover, the resulting smoke and vapors caused by asphalt heating and burning are drawn into the atmosphere and are obviously a pollution hazard. In my previous co-pending applications this disadvantage is eliminated by utilizing heating pipes which not only avoids burning and deterioration of the asphalt, since there is no exposure to flame, but greatly increases the heating efficiency since a significant amount of material is in contact with the hot tubes. Moreover, complete mixing of the composition is greatly facilitated because the pipes act to deflect the material in different directions cascading over the hot tubes as the drum rotates thereby improving the compositions' homogeneity.

In heating and mixing asphalt-aggregate composition in an elongated-cylindrical mixing drum, as the asphalt is heated it becomes rather sticky, sometimes adhering to the heating tubes or pipes, and there is a tendency of the material to become baked or caked on the tubes over periods of use. If the material layer builds up significantly, the apparatus requires cleaning to remove caked material from the heating tube surfaces which otherwise will significantly affect the heating efficiency. It will be appreciated that it may be difficult and inconvenient to open up the cylindrical drum and remove the material from the tubes, especially where a rather large number of tubes is involved. The cleaning procedure may require removing some of the tubes in order to give sufficient access to drum interior in order to remove the composition layer from the exterior tube surface.

From time to time, depending on asphalt and aggregate ratios in compositions introduced into the mixing and heating drum apparatus, longer heating periods are sometimes desired in order to achieve sufficiently high composition temperatures at hot output end. In other words, it may be desirable to slow down the through put rate of the composition between the input and output ends. Heretofore, such a flow rate slow down has been achieved by varying the angle from horizontal or tilt of the mixing drum with angles approaching horizontal naturally slowing down the rate at which the composition is drawn through the apparatus gravitationally. However, as the tilt approaches horizontal, control of the flow rate is decreased and thus such a method is not altogether satisfactory.

Expansion and contraction of the heating tubes or pipes along their length also causes structural problems and eventual deterioration of the apparatus where both ends of the tubes are secured to cylinder walls at each end of the drum apparatus. At the same time, there is a requirement for adequately preventing excessive venting of gases and fumes from the drum interior given off by the heated composition to the atmosphere if the front or rear drum walls are not adequately sealed.

SUMMARY AND OBJECTS OF THE INVENTION

The apparatus of the present invention is designed to obviate the problems and disadvantages indicated hereinabove to achieve an improved apparatus for mixing and heating asphalt-aggregate compositions. Accordingly, it is an object of the invention to provide a heating apparatus of the type described in which the heating tubes or pipes are supported along their length intermediate their ends so as to improve the structural strength characteristics of the apparatus. It is another object of the invention to provide such a heating and mixing apparatus in which the tubes or pipes can be cleaned with removal of built up composition on the exterior wall without substantial disassembly of the drum. It is still another object to provide means for increasing the residence time of the composition within the apparatus, especially for recycle of asphalt-aggregate compositions so that they will become adequately heated and mixed during one pass through the apparatus. It is a further object of the invention to provide a means for allowing adequate expansion and contraction of the heating tubes or pipes as they heat and cool and yet provide adequate insulation between end walls of the drum. These objects as well as others will be evident from the following detailed description of the various embodiments of the invention.

DETAILED DESCRIPTION OF THE INVENTION

Figure 1:
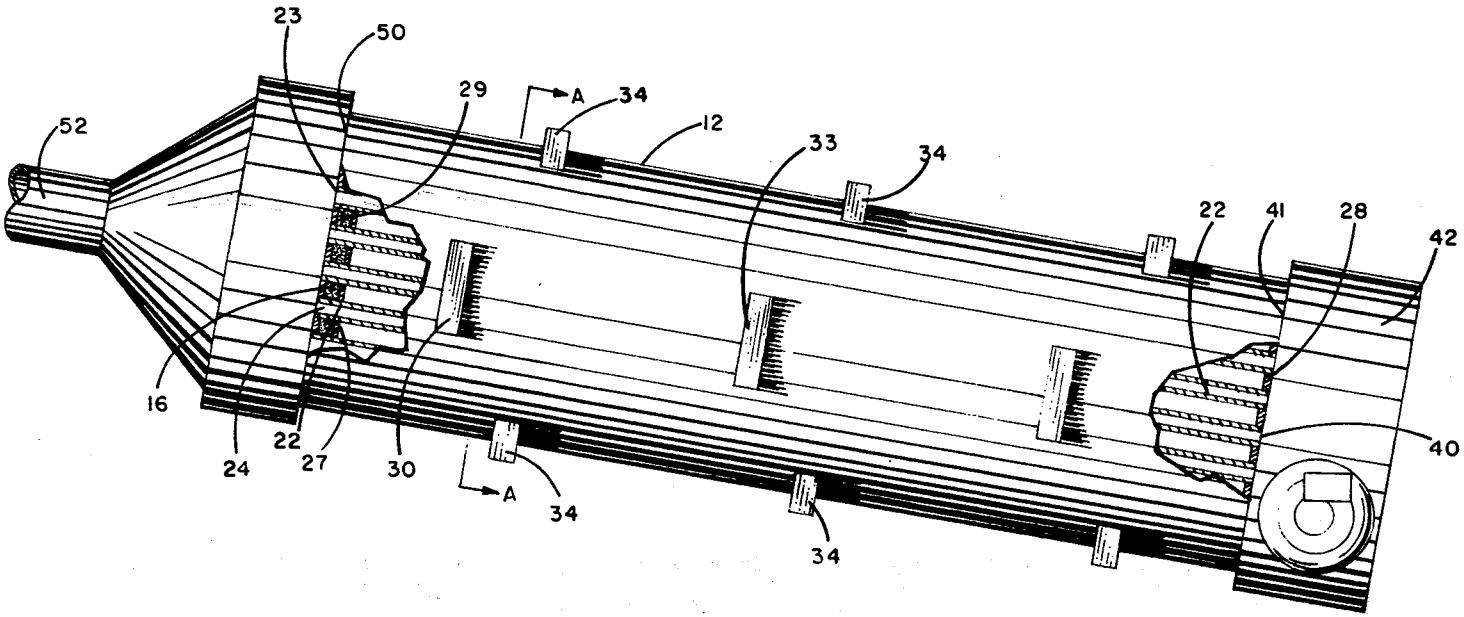
FIG. 1 is a side elevational view partially cut away and partially in section illustrating an improved heating and mixing apparatus of the invention.
Figure 2:
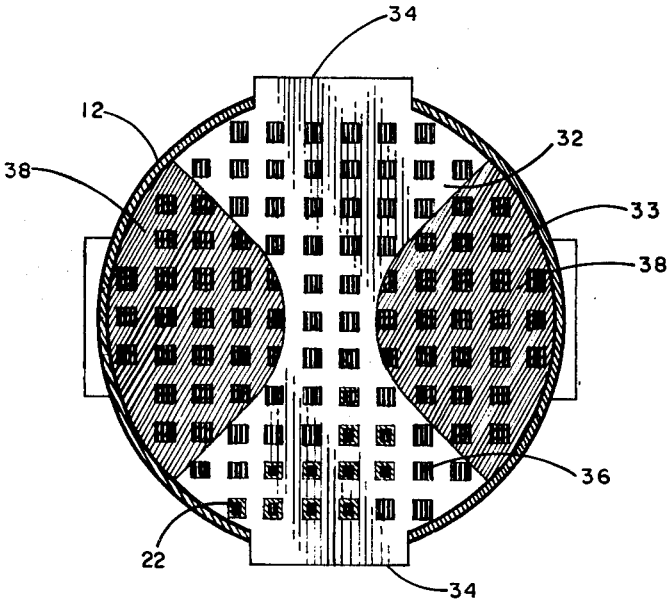
FIG. 2 is a sectional view of the apparatus taken along lines A—A of FIG. 1.

The supporting member concept of the invention is illustrated in FIGS. 1 and 2 which a cylindrical drum 12 includes a plurality of tubes 22 extending between forward and back ends 40 and 50 respectively of the apparatus. At the forward apparatus end is a heating cavity or furnace 42 from which hot gases are directed through forward port 28 of each of the tubes 22 and which hot gases are vented from port 24 at the opposite drum end and exhausted through exhaust apparatus 52. At the forward end of the drum is an end wall 41 to which each of the tubes is secured and which forward end wall acts as a fire wall for the heating apparatus. Composition is recovered via a chute (not shown) extending through the forward end wall and heating cavity. At the opposite end of the drum are back walls 23 and 27 each of which has a plurality of orifices through which the ends of tubes 22 extend and through which there is provided means for introducing composition into the drum interior. In order to allow for tube expansion and contraction as the tubes are heated and cooled during utilization of the apparatus, the portion of the tubes extending through back end walls should not be secured in order that the tubes themselves may expand and contract without warping or otherwise exerting undue pressure on the end walls. For example, if the tubes are attached at both end walls, as the tubes are heated and begin to expand, pressure and stresses against the walls would cause bowing or warping which, during repeated heating and cooling cycles may cause significant structural damage. Thus, to eliminate such a problem, with oversized orifices in back walls 23 and 27, the ends of the tubes are supported therein but the tubes are still free to expand or contract.

Using oversized orifices in the end walls 23 and 27 may result in an excess of gases, smoke, fumes and the like from being vented from the interior of the drum chamber in which the asphalt-aggregate composition is being heated to the exterior which may be undesirable from an air pollution standpoint. Accordingly, in order to minimize this problem an insulating material 29 may be packed into space 16 between end walls 23 and 27 and which packed material will act as a smoke seal between these walls and the tube extending through the wall orifices to significantly reduce the amount of these gases or smoke which can pass. It will be appreciated that the specific types of sealing or packing material is not especially critical, so long as it is able to withstand the temperatures in that area and is sufficiently packed so that the passageways where the gases could pass is substantially blocked or occluded. Steel wool, wire gauze, fiberglass, asbestos, rock wool and the like may be used as the insulating or packing material.

A significant improvement in the apparatus described herein comprises at least one and preferably a plurality of supporting members 32 spaced at intervals along the interior of drum 12 and supporting tubes or pipes 22 which extend through these supporting members. Observing particularly FIG. 2, there is shown a supporting member 32 which is in the form of a baffle plate having a plurality of orifices 36 through which the heating tubes 22 extend. Preferably, the size of the orifices are at least slightly greater than the exterior dimensions of the tubes which extend therethrough to provide room for expansion and contraction of the tube both laterally and longitudinally during tube heating as previously discussed regarding end walls 23 and 27. The orifice shapes are preferably the shape of the exterior of the tubes, such as round, square or rectangular, or other suitable shape, so that the tubes are supported by the plate and lie against a surface of the baffle plate orifice.

Preferably, a portion 34 of each baffle plate 32 extends exteriorly of the drum 12 so as to be exposed at the outside of the drum. Such a feature is illustrated in FIGS. 1 and 2 in which these exteriorly exposed portions protrude somewhat from the exterior drum surface, some of the portions also referenced as 30 and 33. The purpose for this feature is so that the baffle plates can be vibrated from outside the drum by an apparatus which can be placed against the protruding baffle plate portions with the resulting agitation or vibration being translated through the baffle plate to the heating tubes or pipes. Such a procedure is of significant advantage in cleaning the tubes on which layers or coats of the asphalt composition are built up through use of the apparatus. Obviously, as the thickness of the coating on the tube exterior becomes greater, the heating efficiency of the tube is diminished proportionately thereby affecting the overall efficiency of the apparatus in heating the compositions therein. Heretofore, cleaning of the tube exteriors required at least some disassembly of the apparatus, for example, removing the end plates to expose the drum interior and pulling a sufficient number of tubes to allow greater space to work in the drum interior. Moreover, where the tubes were secured to one end plate, it has to be cut away, all of which obviously requires significant inconvenience and down time of the apparatus.

It has now been found that the dried and somewhat hardened and caked asphalt-aggregate composition on the tube exteriors will crack, spall and generally break up in chunks or particles on the pipe exteriors if the tubes are significantly agitated or vibrated. Accordingly, by sufficiently agitating or vibrating the exposed and protruding portion of a baffle plate with vibrator or other similar or equivalent means, this agitation is translated through the plate to the tubes extending therethrough and supported thereon to achieve the desired result. Other equivalent ways of achieving this vibration also may be used. For example rollers having uneven surfaces or edges could be urged against the protruding baffle plate surfaces as the drum is rotated. Alternatively the exposed baffle plate surfaces may be shaped irregularly and vibrated along a roller surface as the drum rotates. In this or similar manner, the heating tubes or pipes may be vibrated at any time to keep the tubes clean and prevent significant build up of material on the exterior tube surfaces.

Another feature of the baffle plates is to provide an intermittent barrier for composition flow as it is drawn through the apparatus. It will be understood that in normal operation, the mixing drum is tilted with the cool end at which the composition is introduced being elevated as compared to the forward or hot end to which the composition is drawn and recovered in the mixing and heating operation. Accordingly, as the drum turns or rotates, the composition is gradually drawn gravitationally from the input to the output end. Observing again FIG. 2, each baffle plate is provided with at least one and preferably two openings 38 through which composition can flow. The size, shape and number of the openings in each plate will depend on the desired flow rate for the compositions through the drum, depending on the drum tilt angle. In the example shown, observing plate 32 and its relationship with the circumference of cylindrical drum 12, the circular drum interior surface is divided into four quandrants with the baffle plate 32 occupying approximately two opposite (upper and lower) quandrants and ports 38 the other opposite (side) quandrants. As the drum is rotated about its central elongated axis, the plate and ports alternately pass through a given portion or area of the drum interior in which composition is located, the major portion being normally along the bottom and up the side in the direction of drum rotation. Since this composition is being gradually drawn along the tilted drum from one end to the other by gravity, its flow will be temporarily stopped as it meets the baffle plate surface until the opening or port in the baffle plate comes around when the composition is again free to flow.

Preferably, a plurality of such baffle plates are located at spaced positions throughout the length of the drum as is illustrated in FIG. 1. It may also be preferred to have adjacent baffle plates disposed so that their openings or ports are located at 90° relative to one another. In other words, observing baffle plate 32 in FIG. 2, in which the plate surface occupies the upper and lower drum quandrants while the openings 38 are in the two side quandrants, an adjacent baffle plate may be positioned 90° relative thereto so that its openings are in the upper and lower drum quandrants. Baffle plate 33 is also observed which is the adjacent plate lying toward the forward drum end. Its openings are not seen since they lie behind and are obscured by plate 32. In FIG. 1 exposed portions 34 of baffle plate 32 are observed protruding from the exterior drum surface in the upper and lower quandrants whereas the adjacent rear baffle plate exposed portion 30 extends along a side quandrant. Again, the purpose and advantage of using the baffle plates with openings is to restrict or retard the gravitational flow of composition along the tilted drum as the composition flows only through the baffle plate openings alternately and temporarily exposed as the drum is rotated.

The specific shape of the baffle plate and size of the openings through which composition passes are not particularly critical. However, where the drum is cylindrical, the baffle plate is conveniently shaped to generally span two opposite or opposed quandrants while the other two opposite quandrants are defined by the openings as shown. However, any other convenient shape for either the baffle plate and the openings may be used so long as they achieve the desired purposes of supporting the heating tubes, allowing for their thermal expansion and contraction, retarding the flow of composition, and offering means for cleaning the tube surfaces utilizing the agitation or vibration techniques.

The distance of separation of the baffle plates as well as the number used along the drum interior will depend on the length of the drum and the tubes extending therein as well the desired barrier or composition flow retard effect. Since tube support is one of the primary functions of the baffle plates, at least one should be located near the mid point of the drum length. Using the opposite quandrant or double pie shape shown in FIG. 2, only about one-half of the tubes will be supported by a single baffle plate so that a pair of adjacent baffle plates midway along the length of the apparatus are desirable. However, where the drum and tubes are of a length so that additional support is necessary, additional pairs of baffle plates may be placed at one-quarter and three-quarter positions along the drum length as illustrated in FIG. 1. This will not only give substantial support to the tubes, provide additional composition barriers and flow retardation, but will also allow for increased vibration and cleaning of the tubes along their length. Thus, again referring to FIG. 1, there being plates disposed both in the forward, rear and center portions of the drum, substantial vibration along the length of the heating tubes for cleaning is possible.

Figure 3:
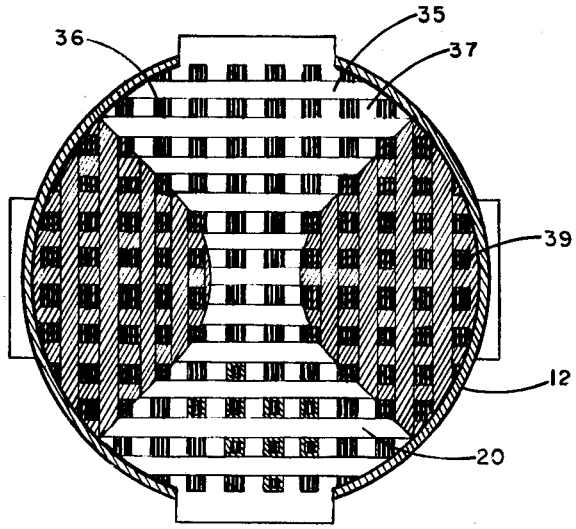
FIG. 3 is a view similar to FIG. 2 illustrating another embodiment for a supporting member according to the invention.

Alternative to the flat plate type of baffle plate shown in FIG. 2, it may instead be formed of a plurality of bars, rods or pipes as shown in FIG. 3. In this embodiment a plurality of horizontal rods 35 and vertical rods 37 and which rods are welded or otherwise secured to form a supporting member 20 having a plurality of orifices 36 through which the hollow tubes extend. The rods are simply cut to length to achieve the desired plate and opening shape and size desired. Exteriorly extending portions are also appropriately secured to the rods so that the overall structure has baffle plate characteristics substantially as previously described. An adjacent supporting member 39 is also viewed in the figure through the openings formed in supporting member 20. Other modifications of the supporting members to achieve the same results are within the purview of the invention and the examples shown are for the purpose of illustration only.

I claim:

1. In a heating and mixing apparatus comprising an elongated drum having a plurality of heating tubes extending along the interior length thereof and end walls at opposite ends of said drum and between which walls said tubes extend said drum being tilted with respect to horizontal with means for introducing composition adjacent one drum end and removing it adjacent the opposite end, and means for rotating said drum whereby said composition is drawn from one end to the other by gravity as said drum is rotated, the improvement comprising at least one support device disposed in said drum intermediate said end walls having at least one opening therein to allow composition to pass therethrough, each support device having a portion extending through an opening in said drum and exposed exteriorly of said drum, a plurality of orifices through which said tubes extend, and means for mechanically vibrating the exteriorly exposed support device portion.

2. Apparatus of claim 1 having a plurality of said support devices spaced along said drum.

3. Apparatus of claim 1 wherein said support device comprises a baffle plate extending between opposite sides of said drum.

4. Apparatus of claim 3 wherein said drum is cylindrical and said plate is in the general shape of a pair of opposite quandrant members connected at a common vertex and wherein said plate is disposed along a plane approximately normal to the axis extending along the length of said drum.

5. Apparatus of claim 4 having at least two of said plates being disposed in opposite quandrants.

* * * * *